US007396217B2

(12) United States Patent
Iwanari

(10) Patent No.: US 7,396,217 B2
(45) Date of Patent: Jul. 8, 2008

(54) FUEL PUMP TO BE INSTALLED INSIDE FUEL TANK

(75) Inventor: Eiji Iwanari, Chiryu (JP)

(73) Assignee: Denso Corporation (JP)

( * ) Notice: Subject to any disclaimer, the term of this patent is extended or adjusted under 35 U.S.C. 154(b) by 529 days.

(21) Appl. No.: 10/730,916

(22) Filed: Dec. 10, 2003

(65) Prior Publication Data

US 2004/0115077 A1 Jun. 17, 2004

(30) Foreign Application Priority Data

Dec. 10, 2002 (JP) ..... 2002-357933
Aug. 20, 2003 (JP) ..... 2003-296141

(51) Int. Cl.
*F04B 35/04* (2006.01)
*F04B 17/03* (2006.01)
*H01R 39/04* (2006.01)

(52) U.S. Cl. ..... 417/423.7; 417/410.3; 310/233

(58) Field of Classification Search ..... 417/423.7, 417/410.3; 310/233
See application file for complete search history.

(56) References Cited

U.S. PATENT DOCUMENTS 6,082,974 A * 7/2000 Takemoto et al. ..... 417/366
6,461,120 B2 * 10/2002 Harakawa et al. ..... 417/371
6,541,889 B2 * 4/2003 Moroto et al. ..... 310/216
2002/0140313 A1 10/2002 Noya et al.

FOREIGN PATENT DOCUMENTS

JP 11-117890 4/1999
JP 11-351159 12/1999

OTHER PUBLICATIONS

Chinese Office Action dated Feb. 13, 2006 (and translation).

* cited by examiner

*Primary Examiner*—Devon Kramer
*Assistant Examiner*—Patrick Hamo
(74) *Attorney, Agent, or Firm*—Nixon & Vanderhye PC

(57) ABSTRACT

A fuel pump for supplying fuel drawn from a fuel tank into an internal combustion engine comprises a rotor, a rotation shaft, bearing members and a drawing force generative means. The rotation shaft revolves integrally with the rotor. The bearing members support both axial ends of the rotation shaft. The stator is disposed on an outer circumference of the rotor and surrounds the rotor. The drawing force generative means generates drawing force for drawing fuel from the fuel tank by means of rotation force of the rotor. The rotor has a recess in a center of its axial end portion. Moreover, at least one of the bearing members is disposed in the recess.

20 Claims, 9 Drawing Sheets

FUEL PUMP TO BE INSTALLED INSIDE FUEL TANK

CROSS REFERENNCE TO RELATED APPLICATION

This application is based on Japanese Patent Applications No. 2002-357933 filed on Dec. 10, 2002 and 2003-296141 filed on Aug. 20, 2003, the disclosure of which is incorporated herein by reference.

FIELD OF THE INVENTION

The present invention relates to a fuel pump for supplying fuel drawn from a fuel tank to an internal combustion engine.

BACKGROUND OF THE INVENTION

As a fuel pump that draws fuel in a fuel tank and supplies it to an engine, one is famous. In the one, a plurality of permanent magnets is disposed inside a housing along the circumference thereof, and an armature is disposed inside of the permanent magnets, thereby forming a driving motor (for example, see JP-A-H11-117890).

A fuel pump is required to be downsized similarly to the other devices used for an engine. However, in a conventional fuel pump as disclosed in JP-A-H11-117890, as shown in FIG. 11, clearances (not shown) for rotating an armature 310 are required to be provided in the axial direction thereof between a shaft 312, which rotates integrally with an armature 310, and bearing members 320, 322, which bear the shaft 312. Moreover, the bearing members 320, 322 should be disposed to occupy a part of the axial length of the fuel pump 300. Therefore, the axial length of the fuel pump 300 is hard to be shortened.

SUMMARY OF THE INVENTION

The purpose of the present invention is to provide a fuel pump the axial length of which can be shortened.

According to the present invention, a rotor has a recess in a center of its axial end portion, and at least one of the bearing members is disposed in the recess. The axial length of the rotor includes at least a part of the lengths of the bearing members, thereby being capable of shortening the axial length of the fuel pump.

Moreover, according to the present invention, the rotor and the drawing force generative means, which is disposed at one axial end of the rotor, are disposed to be overlapped in an axial direction of the rotor. Therefore, the axial length of the fuel pump can be shortened.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PRESENTLY PREFERRED EMBODIMENTS

First Embodiment

Figure 1:
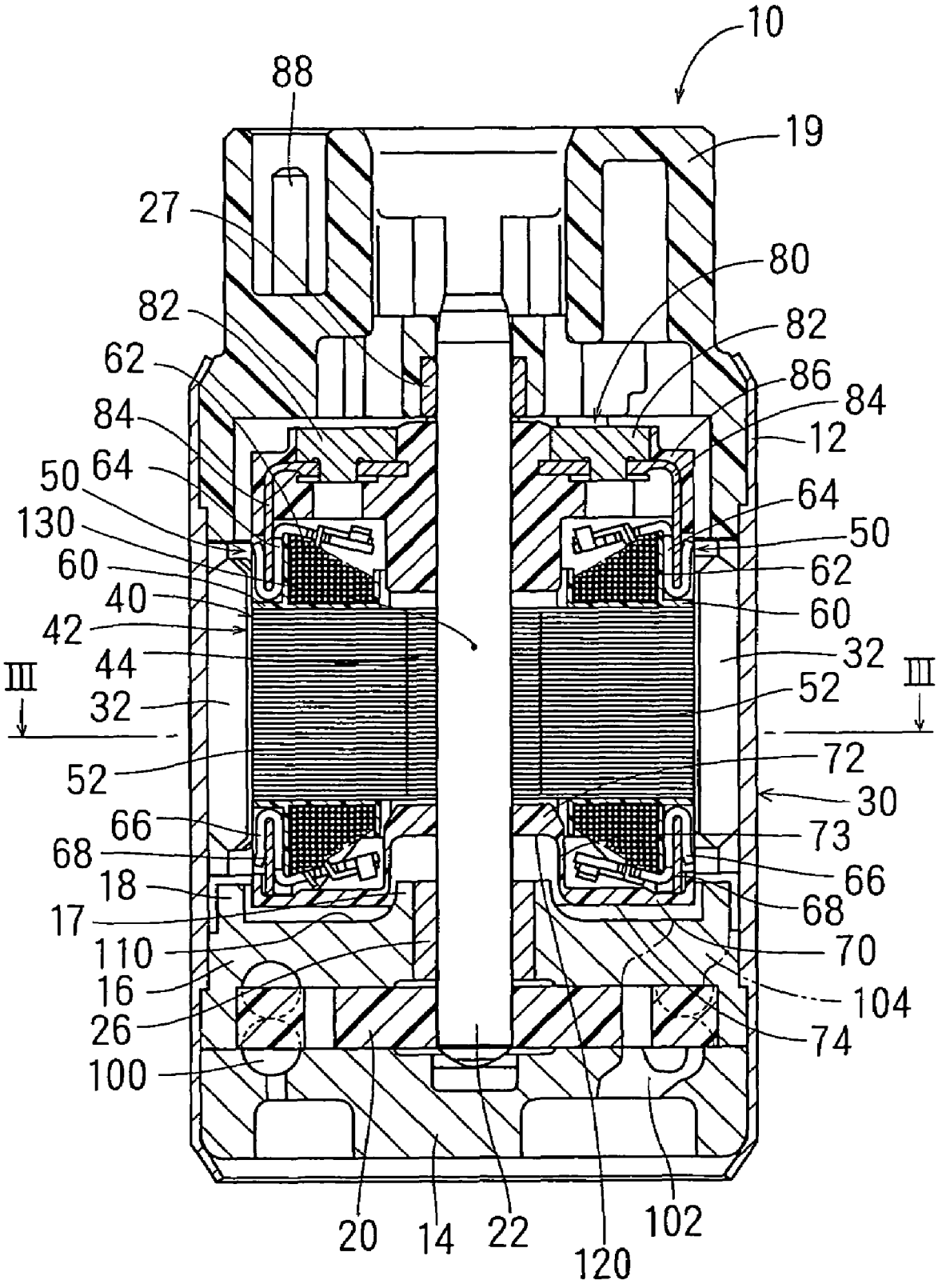
FIG. 1 shows a cross-sectional view of a fuel pump according to a first embodiment of the present invention.

A fuel pump 10 is an in-tank type pump, for example, installed inside a fuel tank of a vehicle, etc. A housing 12 is fixed to caulk a drawing side cover 14 and a discharging side cover 19. The housing 12 constitutes a stator 30 with permanent magnets 32, which will be described later.

A pump casing 16 is cramped between the drawing side cover 14 and the housing 12. A C-shaped pump duct 100 is formed between the drawing side cover 14 and the pump casing 16. The drawing side cover 14 and the pump casing 16 are case members, which rotatably house an impeller 20 serving as a rotation member. The drawing side cover 14, the pump casing 16 and the impeller 20 constitute a drawing force generative means. The pump casing 16 is a rotor 40 side one of the case members storing the impeller 20.

Figure 2:
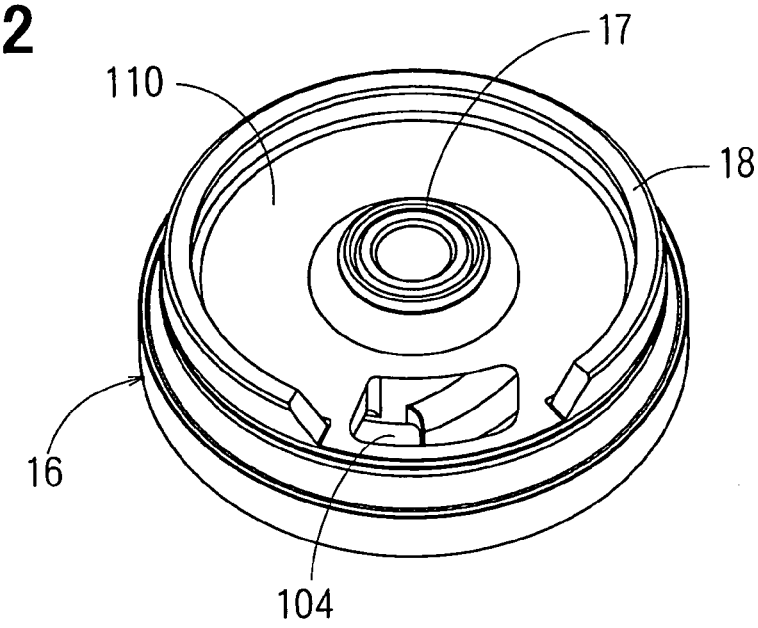
FIG. 2 shows a perspective view of a pump casing of the fuel pump.

As shown in FIG. 2, cylindrical projecting portions 17, 18 are respectively formed in a central portion and an outer peripheral portion of the pump casing 16 on the armature 42 side. The rotor 40 has a recess 120 in a central of its one end portion in an axial direction of a shaft 22, which is the rotation shaft of the rotor 40. The projecting portion 17 of the pump casing 16 projects toward the recess 120, and a part of the projecting portion 17 is disposed inside the recess 120. The pump casing 16 supports a bearing member 26 by its inside of the projecting portion. The projecting portion 18 is formed to be a C-shape and is separated around a position where a communicative passage 104 is formed. The projecting portion 18 is disposed to be overlapped with a permanent magnet 32 in the radial direction thereof.

A great number of fin grooves (not shown) are formed around the outer peripheral edge of the disk-shaped impeller 20. While the impeller 20 rotates integrally with the shaft 22 correspondingly to the rotation of the rotor 40, pressure difference is generated between the front zone and the back zone of the fin grooves of the impeller 20 by force of fluid friction. Moreover, by repeating this by the great number of fin grooves, the fuel in the pump duct 100 is pressurized. The fuel drawn from the fuel tank by force of the rotation of the impeller 20 through a fuel inlet port 102, which is formed in the drawing side cover 14, to a pump duct 100 flows through the communicative passage 104 of the pump casing 16, the outer periphery of the rotor 40 and a unshown fuel outlet port and is discharged into an engine.

The shaft 22 serving (rotation shaft) rotates integrally with the rotor 40 and is borne by bearing members 26, 27, which are housed and supported respectively by the pump casing 16 and the discharging side cover 19. A part of the bearing member 26 is disposed in the recess 120.

Four quarter arc-shaped permanent magnets 32 are disposed circumferentially on the inner wall of the housing 12 and constitute a stator with the housing 12. The permanent magnets 32 form four magnetic poles, the polar characteristics of which are alternately different in the rotational direction.

Figure 3:
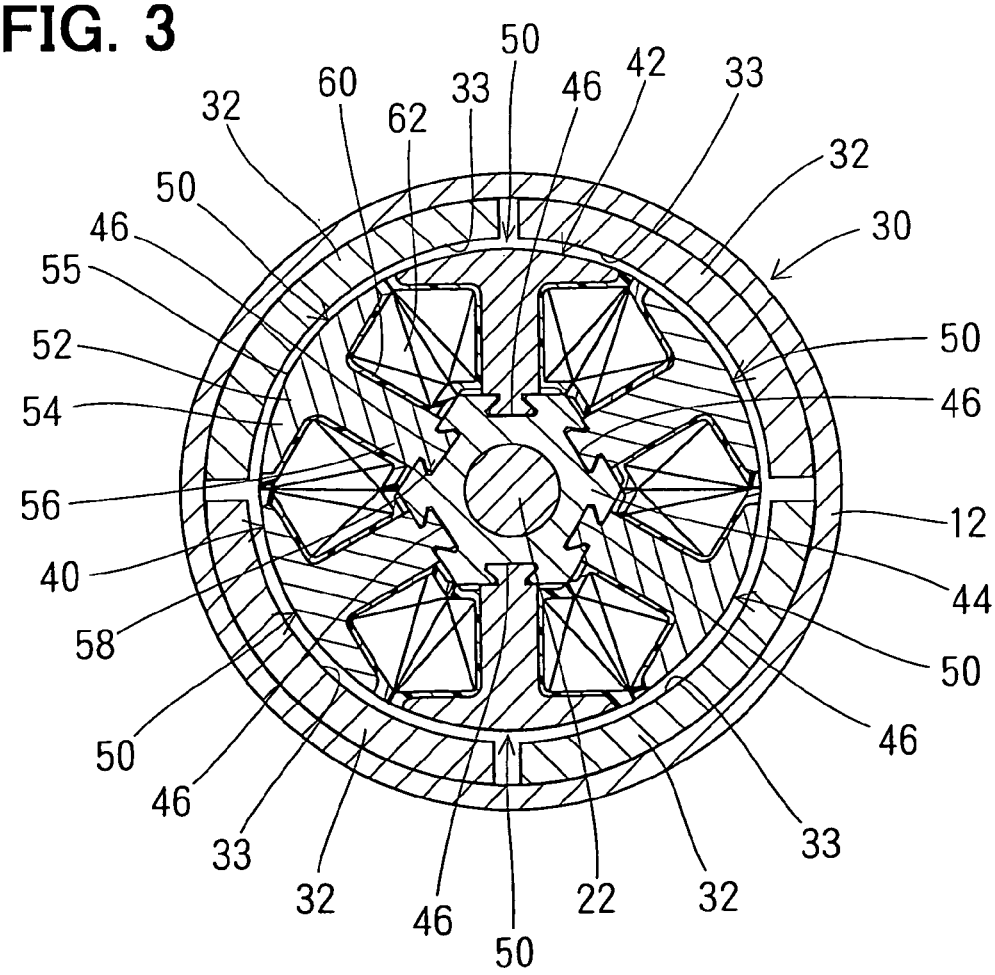
FIG. 3 shows a cross-sectional view taken along a III-III line of FIG. 1.

The rotor 40 has an armature 42 and a commutator 80 and rotates with respect to the shaft 22 serving as the rotation axis. As shown in FIG. 3, the armature 42 has a central core 44 in its rotational center. The central core 44 is formed to be hexagonally cylindrical and has recesses 46, each of which is formed in each outer surface to be extended toward the rotation axis. The width of the recess 46 becomes smaller in the radial direction of the central core.

Six magnetic coil portions 50 are installed on the outer surface of the central core 44 to be arranged in the rotational direction thereof. Each magnetic coil portion 50 has a coil core 52, a bobbin 60 and a coil 62, wound on the bobbin 60. The six magnetic coil portions 50 are formed to be the same structure, and therefore some of the same numerals are omitted in FIG. 3.

Figure 4A:
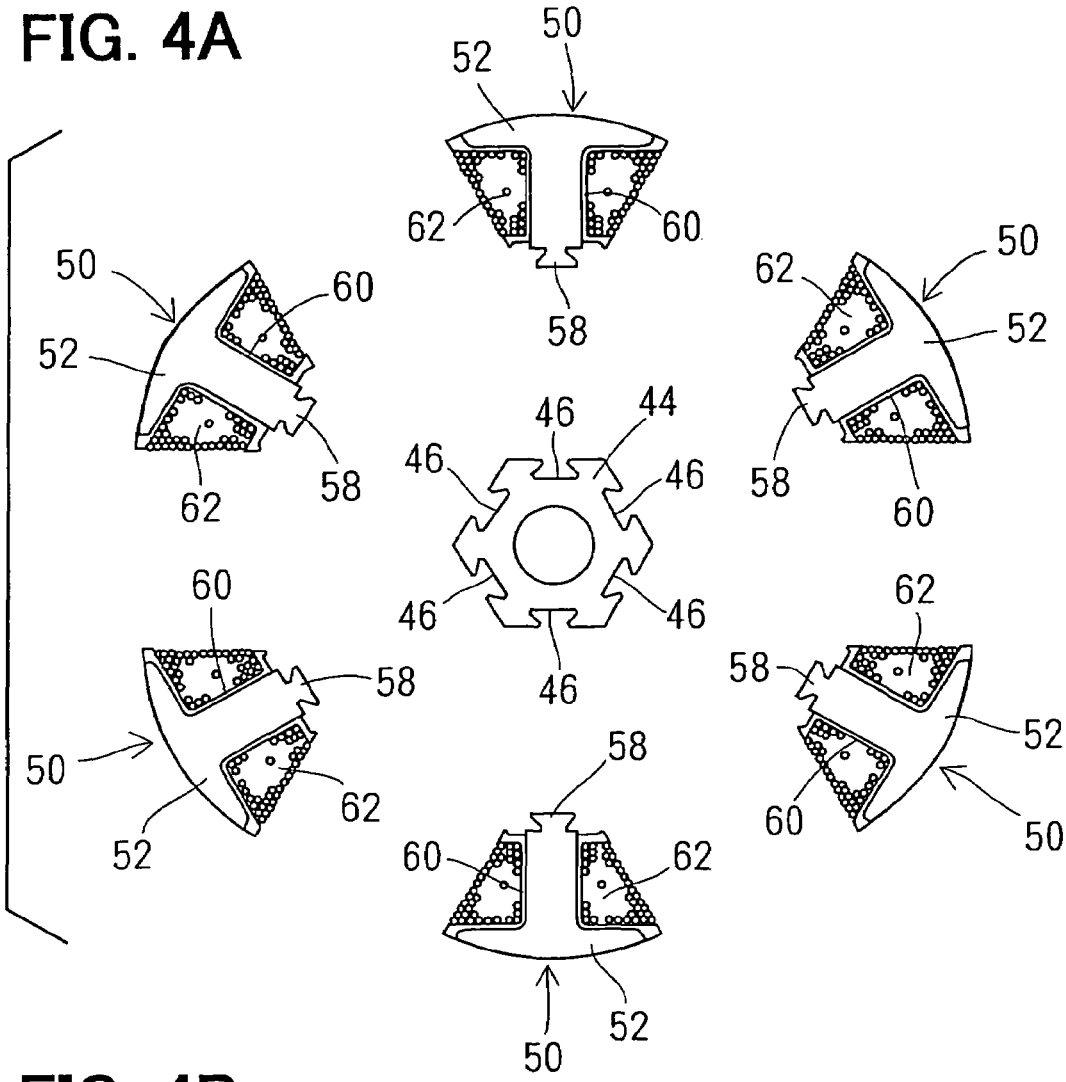
FIG. 4A shows an illustrative diagram of a central core and coil cores of the fuel pump before composed.
Figure 4B:
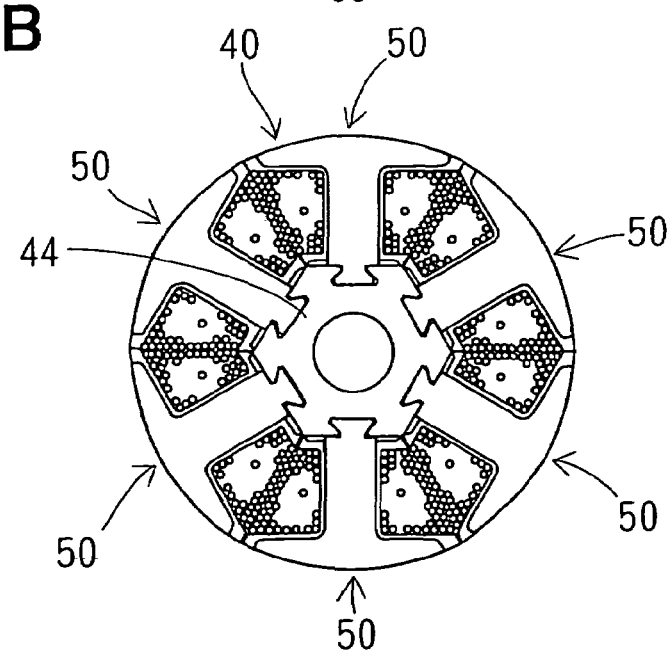
FIG. 4B shows an illustrative diagram of the central core and the coil cores after composed.

As shown in FIG. 4, the coil cores 52 are different members from the central core 44. As shown in FIG. 3, the coil cores 52 have respectively outer circumferential portions 54, which respectively oppose the permanent magnets 32 along the rotational direction, and platy coil wind portions, which respectively extend from the outer circumferential portions 54 toward the central core 44. The coil core 52 has a T-shape in its cross-section perpendicular to the shaft 22. An outer circumferential surface 55 of the outer circumferential portion 54 is formed to be a smoothly projected arc-shape. The clearance between the outer circumferential surface 55 of the outer circumferential portion 54 and the inner surface 33 of the permanent magnet 33 is formed to be uniform in the rotational direction. The coil wind portion 56 has a projecting portion in its central core 44 side, the projecting portion 58 projecting toward the rotational axis. The width of the projecting portion 58 becomes larger toward the central core 44. One of the recess 46 and the projecting portion 58 is inserted into the other one thereof in one direction of the rotational axis, and thereby the recess 46 and the projecting portion 58 are fitted.

Each of bobbins 60 covers a portion of the corresponding coil core 52 other than the outer circumferential surface 55 and the projecting portion 58 thereof. The bobbins 60 magnetically insulate among the outer circumferential portions 54 of the coil cores 52, which are adjacently arranged in the rotational direction. In a cross-section perpendicular to the shaft 22 and penetrating therethrough, the bobbins 60 respectively sandwich the coil wind portions 58 and form substantially trapezoidal wound rooms, the widths of which respectively become smaller from the outer circumferential portions 54 toward the central core 44. The coils 62 are formed by winding a coil in the wound rooms.

Figure 5B:
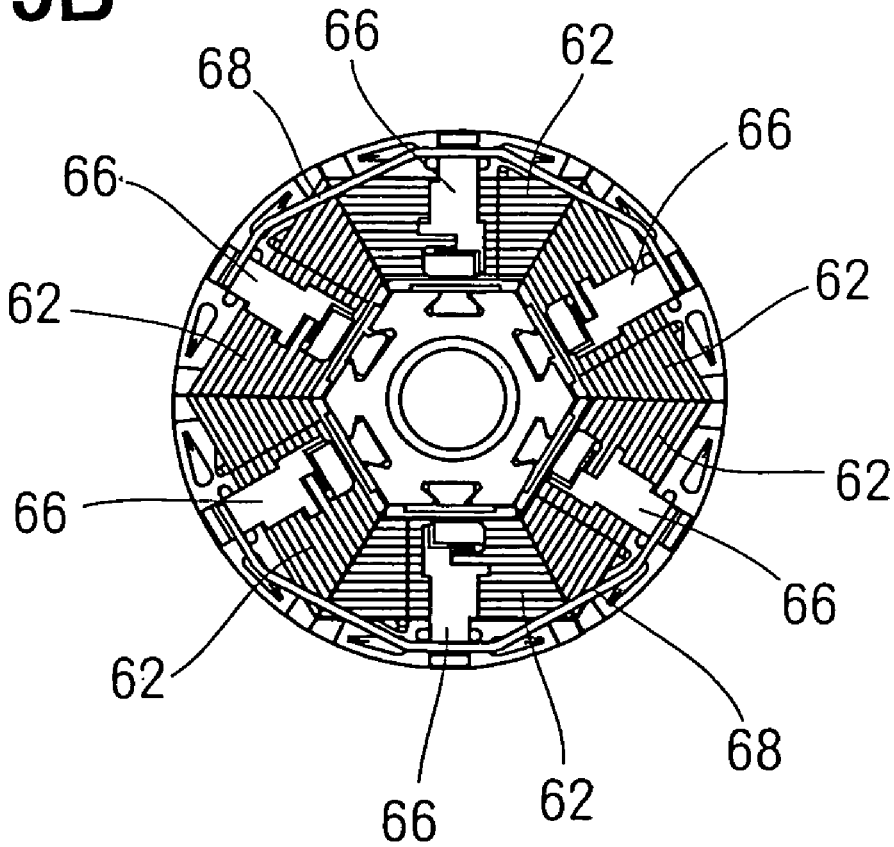
FIG. 5B is a view of the armature viewed from an impeller.
Figure 6:
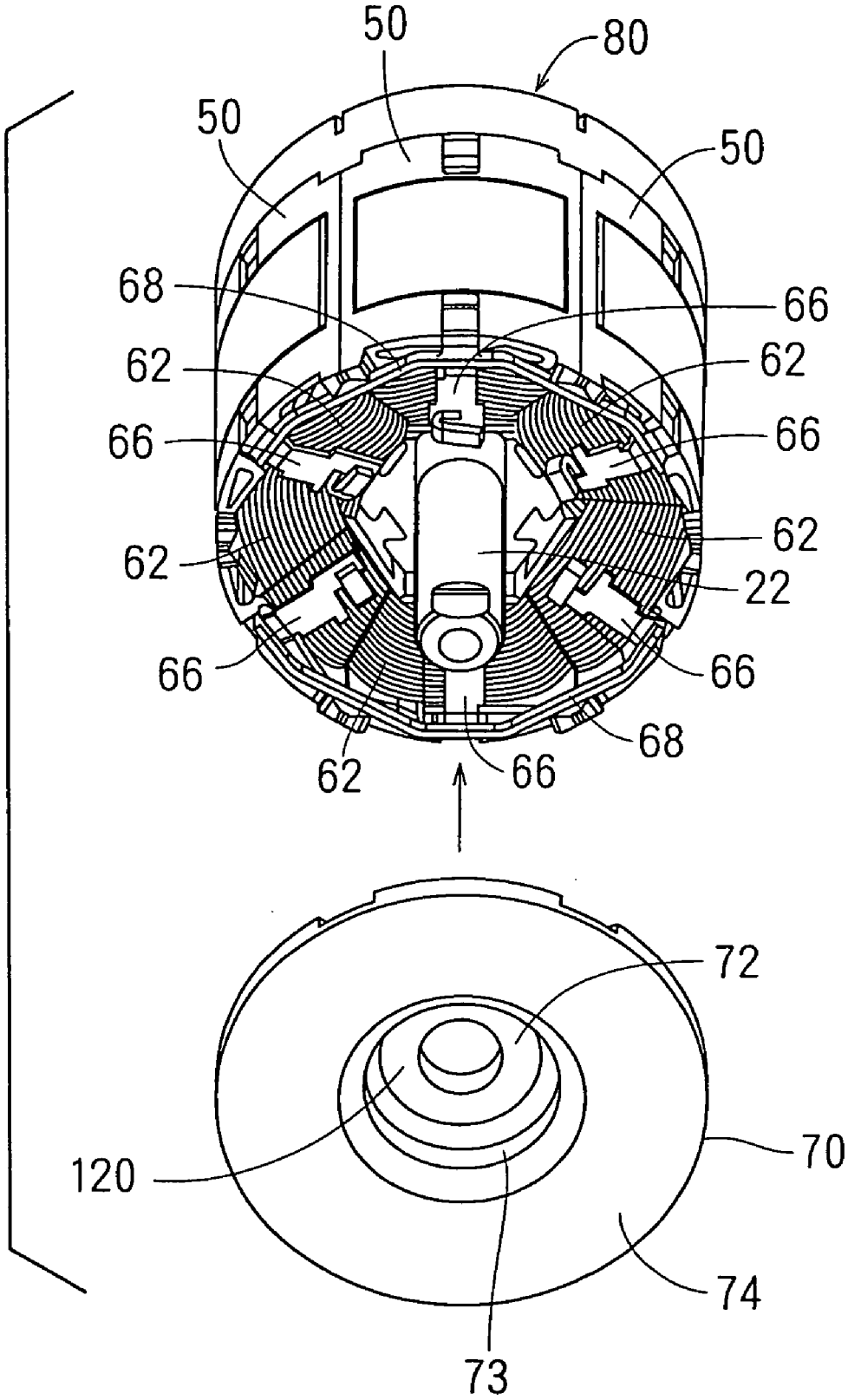
FIG. 6 is a perspective view of a decomposed armature showing the bottom portions thereof.

As shown in FIG. 1, the end of each coil 62 on the commutator 80 side is electrically connected with a corresponding terminal 64 and is electrically connected with each segment 82 of the commutator 80. The end of the coil 62 on the side of the impeller 20 is electrically connected with a corresponding terminal 66. As shown in FIG. 5B, three of the terminals 66, which are closely arranged in the rotational direction, are electrically connected through the use of a terminal 68. The armature 42 has a cover 70, covering one end of the coil 62 on the opposite side of the commutator 80 with respect to the axial direction of the shaft 22 as shown in FIGS. 1 and 6.

The cover 70 has a recess 120 in its part corresponding to an end of the armature 42 with respect to the axial direction of the shaft 22. The cover 70 includes a connective portion 72, a cylindrical portion 73 and an outer circumferential portion 74. The connective portion 72 is connected with the shaft 22 at the bottom center of the recess 120. The cylindrical portion 73 is formed to be extended from the outer periphery of the connective portion 72 toward the opening side of the recess 120 along the shaft 22. The outer circumferential portion 74 is connected with a portion of the cylindrical portion 73 on the anti connective portion side thereof. A step is formed around the connective portion 72 and the cylindrical portion 73. There is a space between the outer surface of the shaft 22 and the inner surface of the cylindrical portion 73, and a part of the projecting portion 17 and a part of the bearing member 26 are disposed therein. The thickness of the connective portion 72 is thicker than that of the cylindrical portion 73. Therefore, the cover 70 is stably connected with the shaft 22. Moreover, the thickness of the cylindrical portion 73 is thin. Therefore, the inner diameter of the recess 120 is formed to be enlarged at most, thereby easily housing the bearing member 26 inside the recess 120 and preventing the recess 120 and the projecting portion 17 from contacting.

As described before, a part of the bearing member 26 and a part of the projecting portion 17 of the pump casing 16 are disposed inside the recess 120. More specifically, the projecting portion 17, the bearing member 26 and the recess 120 are overlapped along the axial direction. In other words, the projecting portion 17, which is a stepped portion of the pump casing 16, is opposed to and overlapped with the cylindrical portion 73, which constitutes a stepped portion of the armature 42. Moreover, the outer circumferential portion 74, which is a projecting portion of the cover 70, is disposed in the recess 110 of the pump casing 16. In brief, the outer circumferential portion 74 and the recess 110 are overlapped in the axial direction.

Figure 5A:
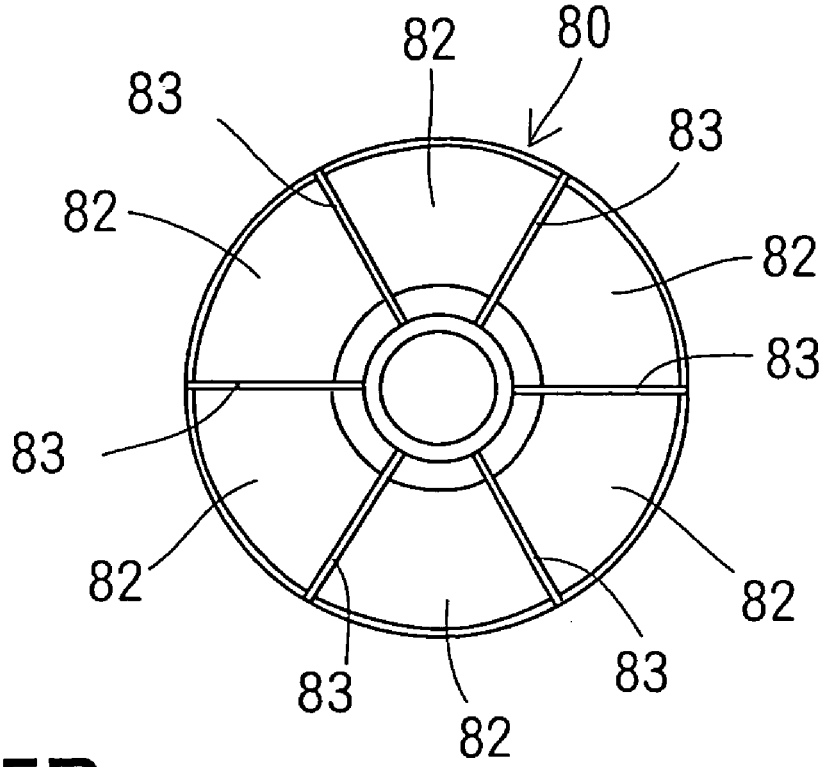
FIG. 5A is a view of an armature of the fuel pump viewed from the commutator.

As shown in FIG. 5A, the commutator 80 has six segments 82 disposed in the rotational direction thereof. The segments 82 are electrically insulated by means of clearances 83 and an insulative resin 86 (see FIG. 1). Each segment 82 is electrically connected with a terminal 84 as shown in FIG. 1. The terminals 84 are respectively connected with the terminals of the armature 42. The commutator 80 rotates integrally with the armature 42, and thereby the segments 82 sequentially contact brushes (not shown). Electricity is supplied to coils 62 of the armature 42 through a terminal 88, which is formed to be inserted in the discharging side cover 19, the blushes, the segments 82, the terminals 84 and the terminals 64. The center of mass 130 of the rotor 40, composed of the armature 42 and the commutator 80, is disposed in the substantial center between the bearing member 26 and the bearing member 27. Force applied to the shaft 22 in the direction perpendicular to the shaft 22 by virtue of the rotation of the rotor 40 can be reduced, and thereby the rotation of the rotor 40 can be stabilized.

Figure 7:
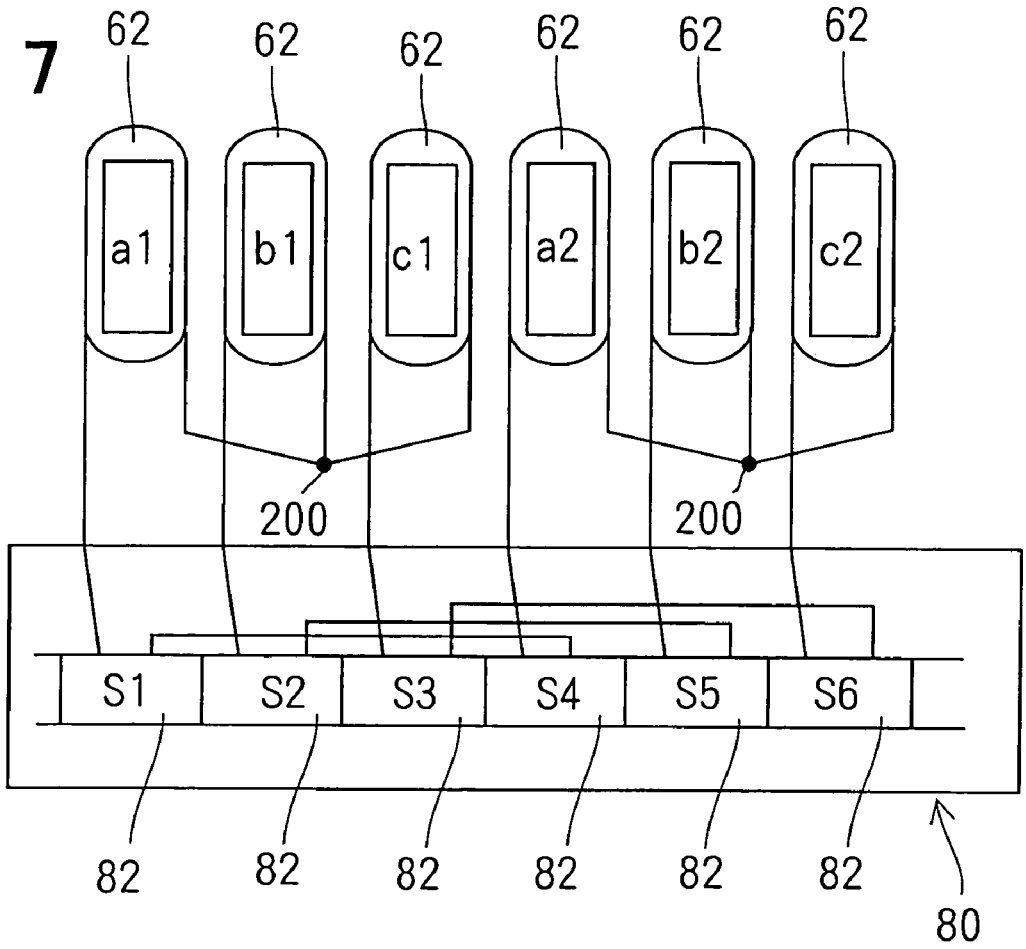
FIG. 7 is a pattern diagram showing connection state of coils of the fuel pump.

As shown in FIG. 7, in the commutator 80, the segment S1 and the segment S4, the segment S2 and the segment S5, and the segment S3 and the segment S6 are respectively electrically connected. In FIG. 7, components a1, b1, c1, a2, b2, c2 show the coils 62, which are disposed inside the armature 42 in this order and in the rotational direction, and components S1, S2, S3, S4, S5, S6 show the segments 82 disposed in the commutator 80 in this order and in the rotational direction.

Figure 8:
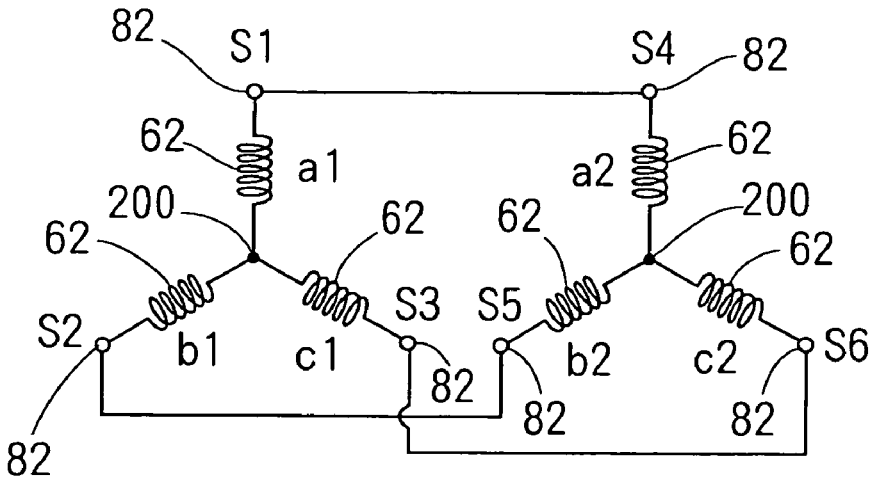
FIG. 8 is a circuit diagram showing the connection state of the coils of the fuel pump.

As shown in FIG. 8, the terminals of the coils 62 on the commutator 80 side and the segments 82 are electrically connected, and the terminals of the coils 62 on the opposite side of the commutator 80 are electrically connected one another. The terminals of the coils 62 on the opposite side of the commutator 80 form a neutral point 200 of star connection. In short, as shown in FIG. 8, the three coils 62 connected by way of the star connection are connected in parallel.

Second Embodiment

Figure 9:
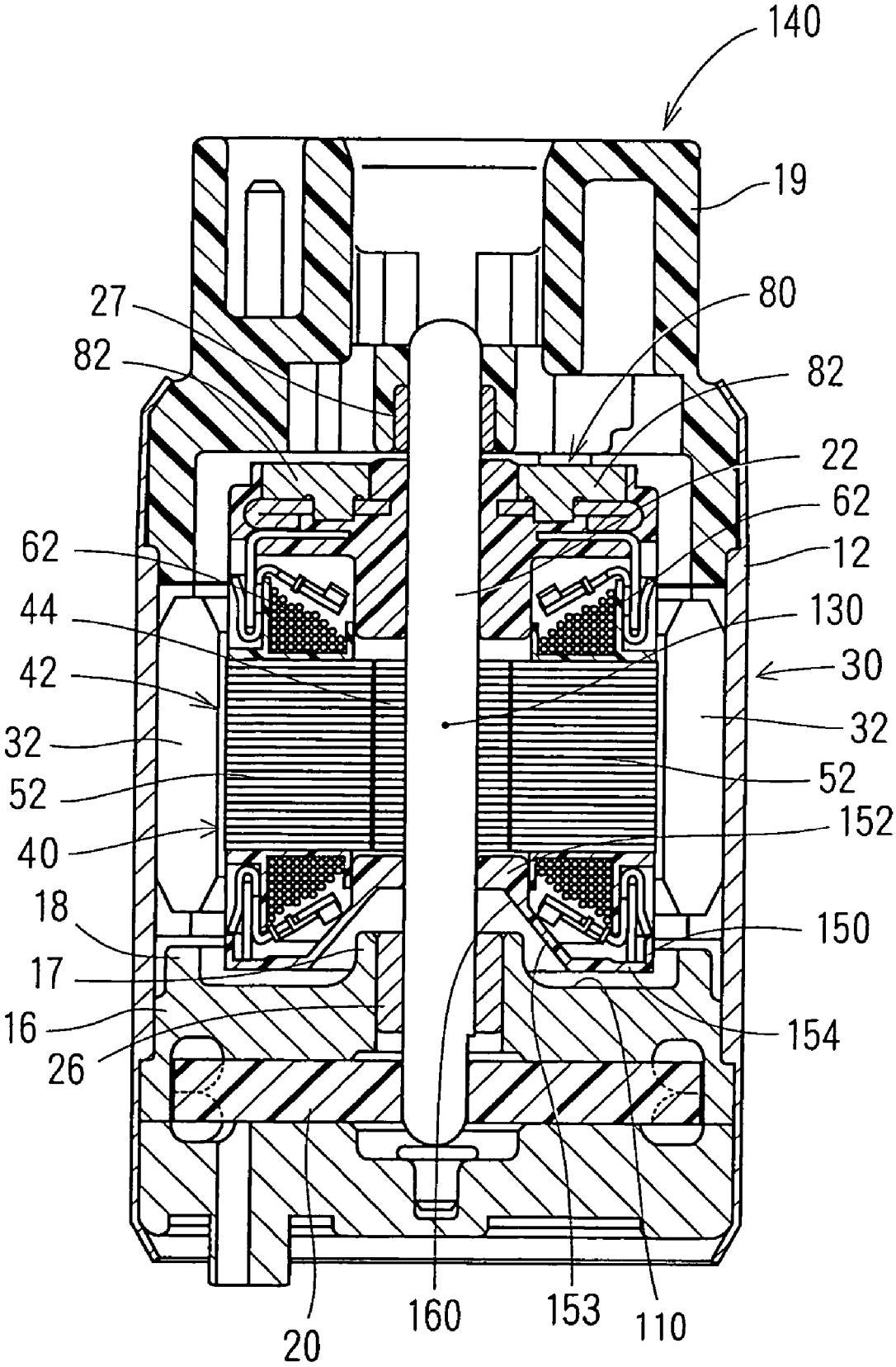
FIG. 9 shows a cross-sectional view of a fuel pump according to a second embodiment of the present invention.

The second embodiment of the present invention is shown in FIG. 9. In a fuel pump 140 according to the second embodiment, components substantially the same as those of the fuel pump 10 according to the first embodiment are indicated by the same numerals.

A cover 150 covers one end portion of each coil 62 in the axial direction of the shaft 22, the end portion being on the opposite side of the commutator 80. The cover 150 has a recess 160 in its position corresponding to the end portion of the armature 40 in the axial direction of the shaft 22. The cover 150 has a connective portion 152, connected with the shaft 22 in the center of the bottom portion of the recess 160, a tapering portion 153, extending aslope from the outer peripheral edge of the connective portion 152 toward the opening of the recess 160 along the shaft 22, and an outer peripheral portion 154, which is connected with an anti connective part of the tapering portion 153. The connective portion 150 and the tapering portion 153 form a stepped portion. Room is provided between the outer surface of the shaft 22 and the inner surface of the tapering portion 153, and a part of a projecting portion 17 and a part of a bearing member 26 is disposed in the room.

A part of the bearing member 26 and a part of the projecting portion 17 of a pump casing 16 are disposed inside the recess 160. More specifically, the projecting portion 17, the bearing member 26 and the recess 160 are overlapped along the axial direction of the shaft 22. In other words, the projecting portion 17, which is a stepped portion of the pump casing 16, and the tapering portion 153, constituting a stepped portion of the rotor 40, are opposed to each other and overlapped along the axial direction. Moreover, the outer peripheral portion 154, which is a projecting portion of the cover 150, is disposed inside the recess 110 of the pump casing 16. That is, the outer peripheral portion 154 and the recess 110 are overlapped in the axial direction.

The thickness of the connective portion 152 is thicker than that of the tapering portion 153, and therefore the cover 150 is stably connected with the shaft 22. Moreover, since the connective portion 152 and the outer peripheral portion 154 are connected by the tapering portion 153, the surface of the cover 150 contacting fuel in the fuel pump 140 is reduced. Therefore, when rotated, resistance between the fuel in the fuel pump 140 and the armature 42 can be reduced. Furthermore, the volume of the cover 150 is reduced, thereby reducing the material cost of the cover 150.

In the above described first embodiment, a part of the bearing member 26 is disposed inside the recess 120 formed in the cover 70 of the armature 42. In the above described second embodiment, a part of the bearing member 26 is disposed inside the recess 160 formed in the cover 150. Therefore, the axial length of the whole fuel pump can be shortened. Moreover, since the projecting portions 17 are respectively disposed inside the recesses 120, 160 of the covers 70, 150, the projecting portions 17 can respectively support the bearing members 26, 27 disposed inside the recesses 120, 160.

Moreover, the end portions of the coils 62 on the side of the pump casings 16 are respectively covered with the covers 70, 150. Therefore, one side of the coil 62, which has a complicated shape and is on the side of the pump casing 16, can be smooth. Accordingly, resistance between the fuel flowing in the fuel pump and the armature 42 by virtue of the rotation and the armature 42 can be reduced.

Moreover, in a cross-section including the shaft 22, the room around the bobbin 60 to be wound with the coil is formed to be a trapezoidal shape, the width of which becomes narrower from the outer circumferential portion 54 toward the central core 44. The room around the bobbins 60 to be wound with a coil forms a recess in the central portion of the bearing member 26. Therefore, by respectively covering the coils 62 with the covers 70, 150, the recesses 120, 160 are formed. Accordingly, the recesses 120, 160 need not be respectively formed in the armatures 42 so as only to shorten the axial lengths thereof.

Moreover, in a cross-section of the armature 42 perpendicular to the shaft 22, the room around the bobbins 60 to be wound with the coil is formed to be a trapezoidal shape, the width of which becomes narrower from the outer circumferential portion 54 toward the central core 44. The armature 42 can be formed in a manner that the magnetic coil portions 50 adjoin one another in the rotational direction with no clearances thereamong. Therefore, the vacant room inside the armature 42 is efficiently used so as to wind the coils on the bobbins 60. Accordingly, the coils can be wound more.

Third Embodiment

Figure 10:
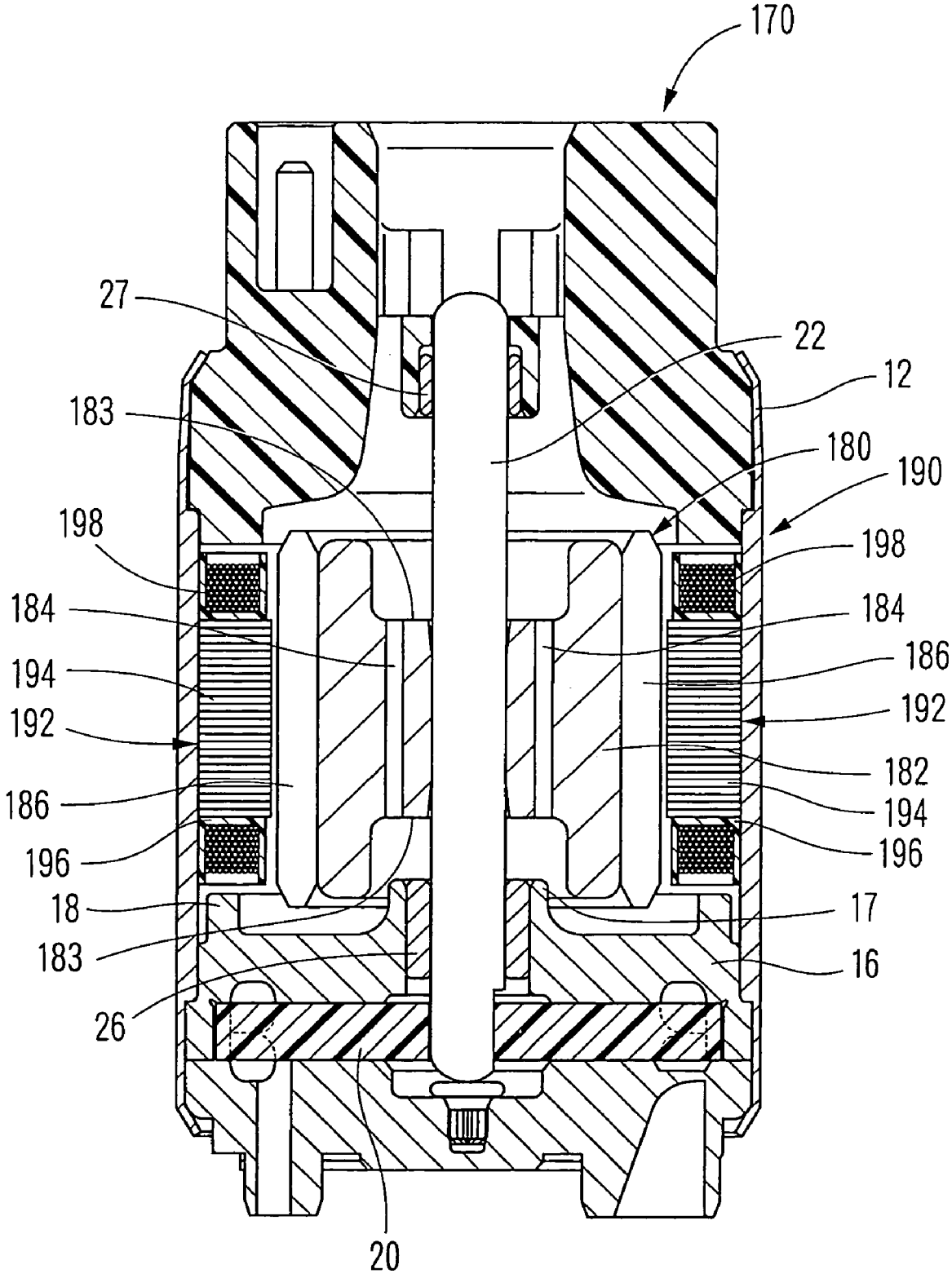
FIG. 10 shows a cross-sectional view of a fuel pump according to the second embodiment of the present invention.
Figure 11:
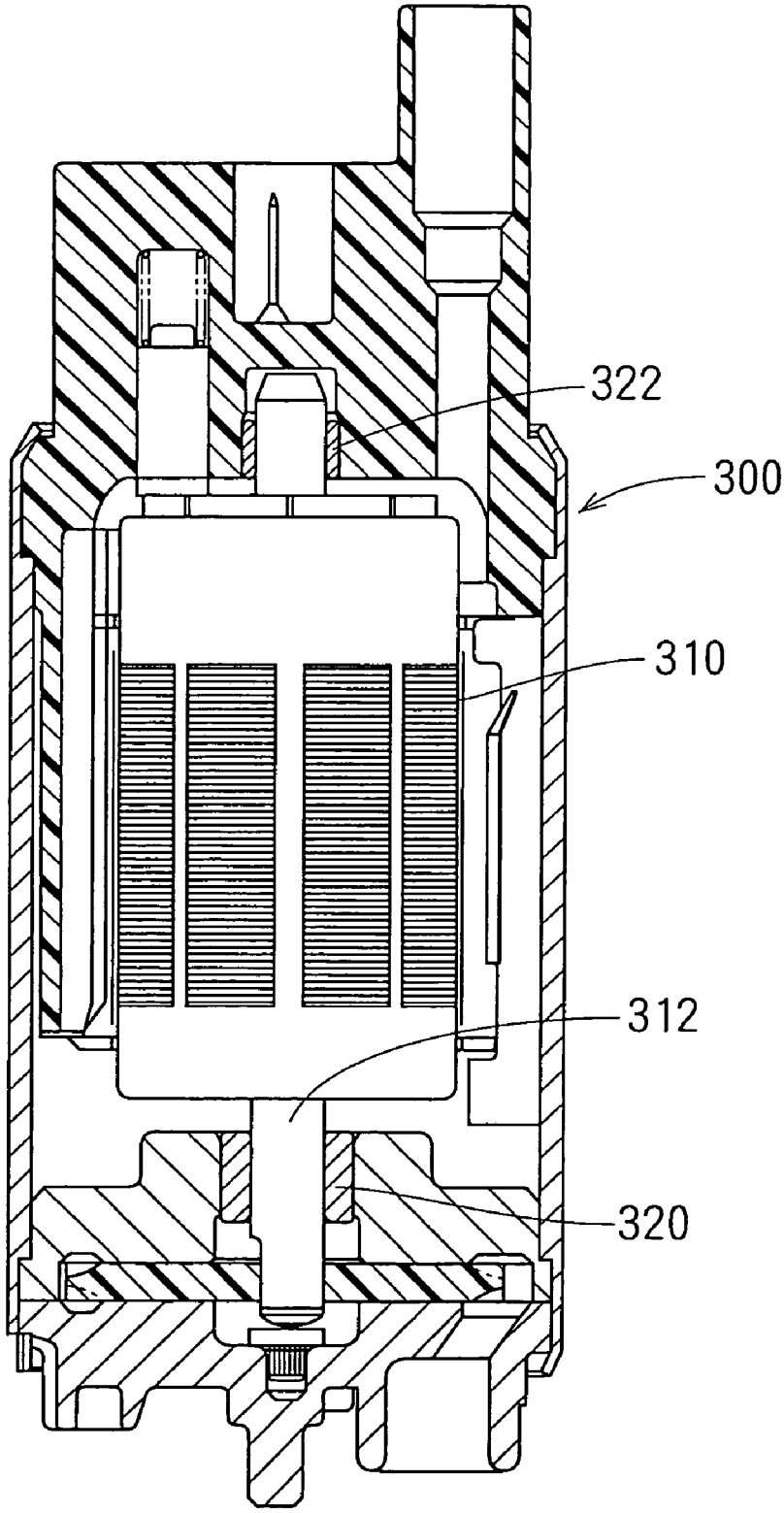
FIG. 11 PRIOR ART
FIG. 11 shows a cross-sectional view of a fuel pump according to a prior art.

The third embodiment of the present invention is shown in FIG. 10. In a fuel pump 170 according to the third embodiment, components substantially the same as those of the fuel pump 10 according to the first embodiment are indicated by the same numerals. The fuel pump 170 according to the third embodiment is a fuel pump employing a brushless electric motor.

A rotor 180 and a stator 190 constitute the electric motor of the fuel pump 170. The rotor 180 is composed of a rotor core 182, installed on the shaft 22, and four permanent magnets 186, installed on the outer surface of the shaft 22, and is rotatably housed inside a stator 190.

A rotor core 182 is formed to be a cylindrical and has a symmetrical shape with respect to the direction of the shaft 22. At the both ends of the rotor core 182, recesses 183 are formed around the shaft 22. Moreover, the rotor core 182 has a through hole 184, penetrating therethrough in the axial direction of the shaft 22 so as to project from the recesses 183. By virtue of the through holes 184, the weight of the rotor core 182 is lightened. Moreover, by changing the position of the through hole 184 or the diameter thereof, the rotational balance of the rotor core 182 can be adjusted. The projecting portion 17 of the pump casing 16 projects toward one of the recesses 183 formed near the rotor core 182, and a part of the projecting portion 17 is disposed inside the recess 183. That is, the rotor 180 and the pump casing 16 are overlapped along the axial direction, thereby shortening the axial length of the fuel pump 170.

Permanent magnets 186 are formed to be 90 degrees arc-shapes and are fixed on the outer surface of the rotor core 182 in the circumferential direction thereof. The permanent magnets 186 alternately form four strange magnetic poles.

The stator 190 has a housing 12, six coil portions 192, which surround the outer surface of the rotor 180, and six magnetic coil portions 192. The magnetic coil portion 192 has a coil core 194, a bobbin 196 and a coil 198 wound on the bobbin 196. Moreover, a hall element (not shown) is, for example, employed as a magnetic position detective means for detecting the rotational portion of the rotor 180 corresponding to the rotation, i.e., the position of the magnetic poles. On the basis of the signal detected in the hall element, electricity supplied to respective coils 198 of the six magnetic coil portions 192 is switched in a switching circuit, such as a transistor. In this way, by controlling and switching the electricity supplied to the respective coils 198 of the stator 190 correspondingly to the position of the magnetic poles of the rotor 180, continuous torque is generated in the rotor 180. The switching circuit may be disposed inside the fuel pump 170 or outside the fuel pump 170.

In the plurality of embodiments described above, by shortening the axial length of the fuel pump, the capacity of the fuel pump is reduced. Therefore, when the fuel pump is activated, the fuel is quickly discharged enough, thereby improving the response performance.

Other Embodiments

In the above embodiments, the projecting portion 17 of the pump casing 16 and the both bearing members 26, 27 are respectively disposed inside the recesses 120, 160, 183. However, at least one of the projecting portion 17 and the bearing members 26, 27 may be disposed inside the corresponding one of the recesses 120, 160, 183. Moreover, the rotor and the pump casing 16 may be disposed so as to be overlapped along the axial direction by deleting the projecting portion 18 of the pump casing 16.

Further, in cases where the rotor and the pump casing 16 are overlapped in the axial direction, a recess may be formed in the rotor or the pump casing 16, and otherwise a projecting portion may be formed inside the recess. Further, the recess and the projecting portion may be disposed apart from the center of the rotor.

In the plurality of embodiments described above, the number of magnetic poles formed by the permanent magnets 32, 186 is four, and the number of the magnetic coil portions 50, 192 is six. However, the number of the magnetic poles formed by the permanent magnets may be two, four or the other even number more than four. Moreover, it is preferable that the number of the magnetic coil portions is more than that of the magnetic poles formed by the permanent magnets. Furthermore, the number of the magnetic coil portions is preferable to be more by two than that of the magnetic poles formed by the permanent magnets.

In the plurality of embodiments described above, the impeller 20 serving as the drawing force generative means is rotated, thereby generating the drawing force for drawing the fuel from the fuel tank. In addition to the impeller, a gear pump structure or etc. can be employed as the drawing force generative means.

What is claimed is:

1. A fuel pump for supplying fuel drawn from a fuel tank into an internal combustion engine, the fuel pump comprising:

a rotor;

a rotation shaft, which revolves integrally with the rotor;

bearing members, which support both axial ends of the rotation shaft;

a stator, which is disposed on an outer circumference of the rotor and surrounds the rotor;

a housing, which houses therein the rotor, the rotation shaft, the bearing members and the stator;

a drawing force generative means, which is fixed to the housing at an axial end of the housing to face the rotor in an axial direction of the rotor generates drawing force for drawing fuel from the fuel tank into the housing by means of rotation force of the rotor, wherein:

the rotor has a recess in a center of its axial end portion;

at least one of the bearing members is disposed in the recess;

the stator has a permanent magnet, which is disposed on its circumference and forms a plurality of magnetic poles the polar characters of which are alternated;

the rotor includes an armature, which is rotatably disposed inside of the stator, and a commutator, which rotates integrally with the armature and has a plurality of segments respectively electrically connected with coils of the armature; and the armature has a cover, which covers one of the axial end portions of the armature and is rotatable with the coils, and said recess in the rotor includes a recess formed in said cover.

2. A fuel pump according to claim 1, wherein:

the drawing force generative means has a rotation member, which rotates integrally with the rotor, and a case member, which houses the rotation member;

the case member has a projecting portion, which is disposed in the recess, and at least one part of the projecting portion projects toward the recess; and the projecting portion supports one of the bearing members by an inner periphery of the projecting portion.

3. A fuel pump for supplying fuel drawn from a fuel tank into an internal combustion engine, the fuel pump comprising:

a housing;

a rotor provided in the housing;

a rotation shaft, which revolves integrally with the rotor;

shaft bearing members, which support both axial ends of the rotation shaft;

a stator, which is disposed in the housing to surround an outer circumference of the rotor; and a drawing force generative means, which generates drawing force for drawing fuel from the fuel tank by means of rotation force of the rotor to supply the fuel through the housing in an axial direction of the rotor, wherein the rotor and the drawing force generative means are disposed to be overlapped in the axial direction of the rotor, wherein:

the rotor and the drawing force generative means respectively have stepped portions;

the rotor and the drawing force generative means are disposed to be overlapped in the axial direction of the rotor so that the stepped portions oppose each other;

the stator has a permanent magnet, which is disposed on its circumference and forms a plurality of magnetic poles the polar characters of which are alternated;

the rotor includes an armature, which is rotatably disposed inside of the stator, and a commutator, which rotates integrally with the armature and has a plurality of segments respectively electrically connected with coils of the armature;

the armature has a cover, which covers one of the axial end portions of the armature, and said stepped portion of the rotor includes a stepped portion formed in said cover, and the cover is rotatable with the coils of the armature and faces the drawing force generative means.

4. A fuel pump according to claim 2, wherein at least one part of the projecting portion is disposed in the recess, and thereby the rotor and the drawing force generative means are disposed to be overlapped in an axial direction of the rotor.

5. A fuel pump according to claim 4, wherein the rotor has a recess in a center of its axial end portion.

6. A fuel pump according to claim 5, wherein the drawing force generative means has a rotation member, which rotates integrally with the rotor, and a case member, which houses the rotation member.

7. A fuel pump according to claim 1, wherein: the cover has a connective portion, which is disposed at a bottom of the recess and connected with the rotation shaft, and a cylindrical portion, which extends from an outer periphery of the connective portion to an opening of the recess along the rotation shaft; and thickness of the connective portion is thicker than thickness of the cylindrical portion.

8. A fuel pump according to claim 1, wherein: the armature includes a plurality of bobbins arranged in the circumferential direction of the armature; and each bobbin is wound with a coil by way of concentrated winding.

9. A fuel pump according to claim 8, wherein the armature includes: a central core, which is disposed in the rotational center of the armature; and a plurality of coil cores magnetically connected with the central core, the coil cores being different bodies from the central core and disposed in the outer circumference of the central core to be arranged in the circumferential direction thereof.

10. A fuel pump according to claim 8, wherein a room around each bobbin to be wound with a coil is formed to be a trapezoidal shape that becomes smaller from the outer periphery to the rotational center of the coil core.

11. A fuel pump according to claim 1, wherein the position of the centroid of the rotor is positioned in the substantial center between the bearing members.

12. A fuel pump according to claim 3, wherein the position of the centroid of the rotor is positioned in the substantial center between the bearing members.

13. An apparatus for supplying fuel drawn from a fuel tank, the apparatus comprising:

a rotor including armature coils;

a rotation shaft, which revolves integrally with the rotor;

bearing members, which support both axial ends of the rotation shaft;

a stator disposed around an outer circumference of the rotor;

a drawing force generative means, which is disposed adjacent to the rotor in an axial direction of the rotation shaft and generates drawing force for drawing fuel from the fuel tank by means of rotation force of the rotor and supplying the fuel into a space between the rotor and the stator in the axial direction, wherein:

the rotor has a recess in a center of one axial end portion thereof, which faces the drawing force generative means;

at least one of the bearing members is disposed in the recess to overlap with the rotor in the axial direction; and a cover provided over a surface of the one axial end portion of the rotor thereby to smooth flow of the fuel supplied through the drawing force generative means, the cover being rotatable with the rotor.

14. An apparatus according to claim 13, wherein the cover has a tapering part disposed circumferentially around the rotation shaft, a diameter of the tapering part being gradually increased from the center of said one axial end portion of the rotor toward the drawing force generative means.

15. An apparatus according to claim 13, wherein said cover is disposed between said at least one bearing member and said recess in the rotor.

16. A fuel pump according to claim 1, wherein said cover is disposed between said at least one bearing member and said recess in the rotor.

17. A fuel pump according to claim 1, wherein said recess in said cover defines a receptacle opening away from the armature that at least partially receives said at least one bearing member.

18. An apparatus according to claim 13, further comprising:

a housing in which the rotor is rotatably provided and to which the stator is fixedly provided, wherein the drawing force generative means is positioned at one axial end of the housing.

19. An apparatus for supplying fuel drawn from a fuel tank into an internal combustion engine, the apparatus comprising:

a housing;

a rotor provided in the housing and having a recess in a radial center portion of an axial end portion thereof;

a rotation shaft passing through the radial center portion of the rotor and rotatable with the rotor;

a stator disposed in the housing to surround an outer circumference of the rotor;

a pump cover having a fuel inlet port;

a pump casing attached to the pump casing and positioned between the pump cover and the rotor, the pump casing having a fuel outlet port from which fuel is discharged into the housing; and an impeller disposed between the pump cover and the pump casing and fixed to the rotation shaft to be rotated by the rotation shaft, wherein:

the pump casing rotatably supports the rotation shaft therein, the pump casing is disposed to extend into the recess of the pump casing in an axial direction of the rotation shaft, the pump casing has a radial center portion, which rotatably supports the rotation shaft and projects into the recess to overlap with the rotor in the axial direction of the rotation shaft, the pump cover and the pump casing are provided in the housing with the stator and the rotor, and the pump cover closes one axial end of the housing, the rotor has a core fixed to the rotation shaft and coils extending from the core in the axial direction of the rotation shaft to form the recess in a radially inside part thereof, and the rotor has a cover, which covers an axial end face of the coils to smooth the axial end face of the coils and promotes smooth flow of fuel into a space between the rotor and the stator.

20. An apparatus according to claim 19, further comprising:

a bearing disposed between the rotation shaft and the radial center portion of the pump casing to rotatably support the rotation shaft, the bearing being disposed in the recess of the rotor.

* * * * *